US006202048B1

(12) United States Patent
Tsuchiya et al.

(10) Patent No.: US 6,202,048 B1
(45) Date of Patent: Mar. 13, 2001

(54) PHONEMIC UNIT DICTIONARY BASED ON SHIFTED PORTIONS OF SOURCE CODEBOOK VECTORS, FOR TEXT-TO-SPEECH SYNTHESIS

(75) Inventors: Katsumi Tsuchiya; Takehiko Kagoshima; Masami Akamine, all of Hyogo-ken (JP)

(73) Assignee: Kabushiki Kaisha Toshiba, Kawasaki (JP)

( * ) Notice: Subject to any disclaimer, the term of this patent is extended or adjusted under 35 U.S.C. 154(b) by 0 days.

(21) Appl. No.: 09/239,966

(22) Filed: Jan. 29, 1999

(30) Foreign Application Priority Data

Jan. 30, 1998 (JP) ..... P10-018882

(51) Int. Cl.[7] ..... G10L 13/06; G10L 19/12

(52) U.S. Cl. ..... 704/260; 704/262; 704/264; 704/267

(58) Field of Search ..... 704/222, 223, 704/260, 262, 264, 267

(56) References Cited

U.S. PATENT DOCUMENTS

| | | | | |
|---|---|---|---|---|
| Re. 36,646 | * | 4/2000 | Akamine et al. | 704/223 |
| 5,230,036 | * | 7/1993 | Akamine et al. | 704/200 |
| 5,268,991 | * | 12/1993 | Tasaki | 704/220 |
| 5,396,576 | * | 3/1995 | Miki et al. | 704/222 |
| 5,651,090 | * | 7/1997 | Moriya et al. | 704/200.1 |
| 5,819,213 | * | 10/1998 | Oshikiri et al. | 704/222 |
| 6,052,661 | * | 4/2000 | Yamaura et al. | 704/222 |
| 6,055,496 | * | 4/2000 | Heidari et al. | 704/222 |
| 6,094,630 | * | 7/2000 | Nomura | 704/223 |

FOREIGN PATENT DOCUMENTS

| | | |
|---|---|---|
| 8-8500 | 1/1996 | (JP) . |
| 8-8501 | 1/1996 | (JP) . |

* cited by examiner

*Primary Examiner*—Tālivaldis I. Šmits
(74) *Attorney, Agent, or Firm*—Oblon, Spivak, McClelland, Maier & Neustadt, P.C.

(57) ABSTRACT

A speech synthesis apparatus synthesize a speech signal by filtering a speech source signal through a synthesis filter. A speech source signal codebook stores a plurality of speech source signals as a code vector. A unit dictionary memory stores a plurality of synthesis units corresponding to phonemic symbols, each synthesis unit comprising an index of the code vector in the speech source codebook and a shift number for the code vector to decode the speech source signal. A unit selection section selects a synthesis unit corresponding to phonemic symbols to be synthesized from the unit dictionary memory. A synthesis unit decoder selects the code vector corresponding to the index in the synthesis unit from the speech source signal codebook, and shifts the code vector according to the shift number in the synthesis unit.

23 Claims, 10 Drawing Sheets

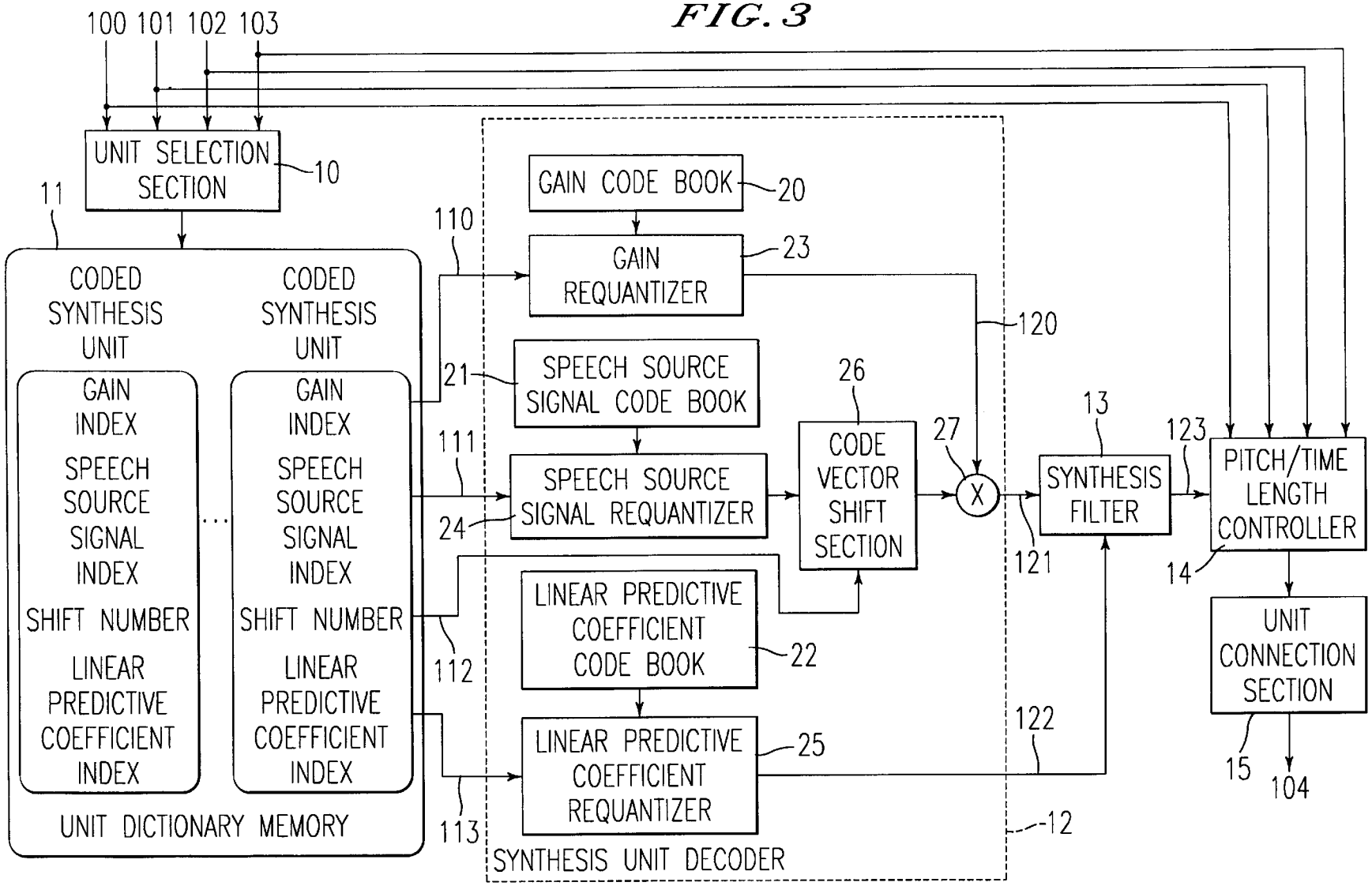
FIG. 3
100 101 102 103
UNIT SELECTION SECTION
10
11
CODED SYNTHESIS UNIT
GAIN INDEX
SPEECH SOURCE SIGNAL INDEX
SHIFT NUMBER
LINEAR PREDICTIVE COEFFICIENT INDEX
CODED SYNTHESIS UNIT
GAIN INDEX
SPEECH SOURCE SIGNAL INDEX
SHIFT NUMBER
LINEAR PREDICTIVE COEFFICIENT INDEX
UNIT DICTIONARY MEMORY
110
111
112
113
GAIN CODE BOOK
20
GAIN REQUANTIZER
23
SPEECH SOURCE SIGNAL CODE BOOK
21
SPEECH SOURCE SIGNAL REQUANTIZER
24
CODE VECTOR SHIFT SECTION
26
27
LINEAR PREDICTIVE COEFFICIENT CODE BOOK
22
LINEAR PREDICTIVE COEFFICIENT REQUANTIZER
25
SYNTHESIS UNIT DECODER
12
120
121
122
SYNTHESIS FILTER
13
123
PITCH/TIME LENGTH CONTROLLER
14
UNIT CONNECTION SECTION
15
104

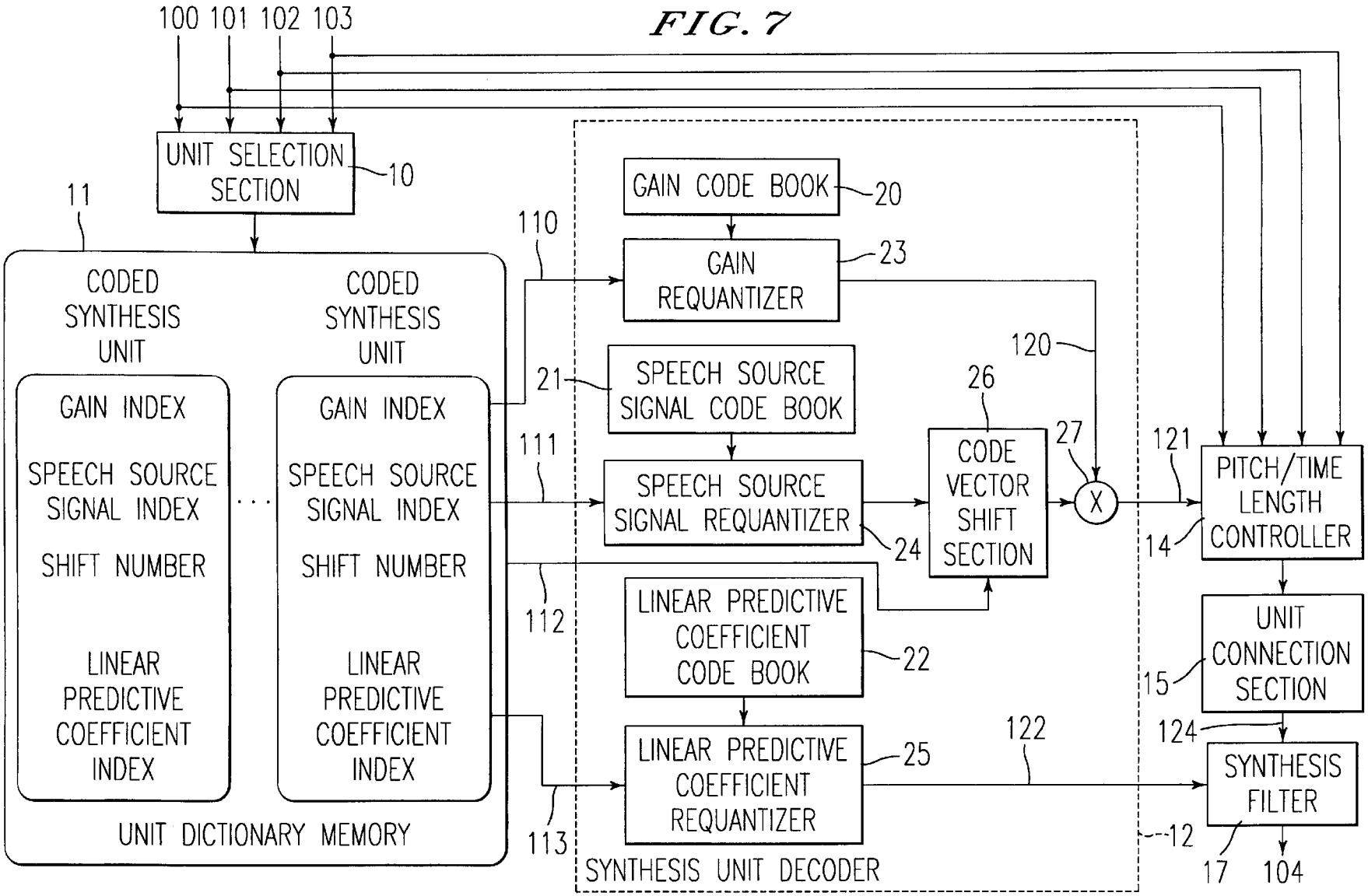
FIG. 7
100 101 102 103
UNIT SELECTION SECTION
10
11
CODED SYNTHESIS UNIT
GAIN INDEX
SPEECH SOURCE SIGNAL INDEX
SHIFT NUMBER
LINEAR PREDICTIVE COEFFICIENT INDEX
CODED SYNTHESIS UNIT
GAIN INDEX
SPEECH SOURCE SIGNAL INDEX
SHIFT NUMBER
LINEAR PREDICTIVE COEFFICIENT INDEX
UNIT DICTIONARY MEMORY
110
111
112
113
GAIN CODE BOOK
20
GAIN REQUANTIZER
23
SPEECH SOURCE SIGNAL CODE BOOK
21
SPEECH SOURCE SIGNAL REQUANTIZER
24
LINEAR PREDICTIVE COEFFICIENT CODE BOOK
22
LINEAR PREDICTIVE COEFFICIENT REQUANTIZER
25
CODE VECTOR SHIFT SECTION
26
27
120
122
121
PITCH/TIME LENGTH CONTROLLER
14
UNIT CONNECTION SECTION
15
124
SYNTHESIS FILTER
17
104
12
SYNTHESIS UNIT DECODER

PHONEMIC UNIT DICTIONARY BASED ON SHIFTED PORTIONS OF SOURCE CODEBOOK VECTORS, FOR TEXT-TO-SPEECH SYNTHESIS

FIELD OF THE INVENTION

The present invention relates to a speech synthesis apparatus and a method to generate a synthesis speech signal by filtering a speech source signal through a synthesis filter in case of text-to-speech system.

BACKGROUND OF THE INVENTION

A speech synthesis method is a technique to automatically generate a synthesized speech signal from inputted prosodic information. According to the prosodic information such as phonemic symbols, phonemic time length, pitch pattern and power, characteristic parameter of small unit (synthesis unit) such as syllable, phoneme, one pitch interval stored in a unit dictionary memory is selected. After controlling the pitch and the continuous time length, the characteristic parameters are connected to generate a synthesis speech signal. The speech synthesis technique by this synthesis method by rule is used for text-to speech system to artificially generate a speech signal from an arbitrary text.

In this speech synthesis technique, in order to improve the quality of the synthesized speech signal, as the characteristic parameter of synthesis unit, a waveform extracted from speech data or a pair of speech source signals obtained by analyzing the speech data and coefficients representing a characteristic of the synthesis filter is used.

In the latter case, in order to further improve the quality of synthesized speech, a large number of synthesis units consisting of the speech source signal and the coefficients are stored in the unit dictionary. Suitable synthesis units are selected from the unit dictionary and connected to generate the synthesized speech. In this method, in order to avoid an increase of memory capacity of the unit dictionary, the unit dictionary is previously coded. When synthesizing the speech signal, the coded unit dictionary is decoded by referring to the codebook.

FIG. 1 is a block diagram of the speech synthesis apparatus using the coded unit dictionary information according to the prior art. First, according to the phonemic symbols 100, the phonemic time length 101, the pitch pattern 102 and the power 103, a unit selection section 10 selects a coded representative synthesis unit from the unit dictionary memory 11. FIG. 2 is a schematic diagram of the coded synthesis unit in the unit dictionary memory 11. As shown in FIG. 2, a linear predictive coefficient used as filter coefficient in the synthesis filter is stored as a code index 113 in a linear predictive coefficient codebook 22 (hereafter, it is called as the linear predictive coefficient index 113). The speech source signal is stored as a code index 111 in a speech source signal codebook 21 (hereafter, it is called as the speech source signal index 111). A gain is stored as a code index 110 in a gain codebook 20 (hereafter, it is called as the gain index 110).

The coded synthesis unit selected by the unit selection section 10 is inputted to a synthesis unit decoder 12. In the synthesis unit decoder 12, a linear predictive coefficient requantizer 25 selects a code vector corresponding to the linear predictive coefficient index 113 from a linear predictive coefficient codebook 22 and outputs a requantized (decoded) linear predictive coefficient 122. A speech source signal requantizer 24 selects a code vector corresponding to the speech source signal index 111 from a speech source signal codebook 21 and outputs a requantized (decoded) speech source signal. A gain requantizer 23 selects a code vector corresponding to the gain index 110 from a gain codebook 20 and outputs a requantized (decoded) gain 120. A gain multiplier 27 multiplies the gain 120 with the speech source signal decoded by the speech source signal requantizer 24. The linear predictive coefficient 122 decoded by the linear predictive coefficient requantizer 25 is supplied to the synthesis filter 13 as filter coefficient information. The synthesis filter 13 executes a filtering process for the speech source signal 121 multiplied with the gain 120 and generates a speech signal 123. A pitch/time length controller 14 controls the pitch and the time length of the speech signal 123. A unit connection section 15 connects a plurality of the speech signals whose pitch and time length are controlled. In this way, a synthesis speech signal 104 is outputted.

In this synthesis system by rule, the coded synthesis unit in the unit dictionary memory largely affects the quality of synthesized speech.

In order to rise the quality of speech, in other words, in order to suppress a falling of the quality of synthetic speech by coding, the number of bits for coding of the synthesis unit must be increased. However, if the number of bits for coding increases, the memory capacity requirement of the gain codebook 20, the speech source signal codebook 21, and the linear predictive coefficient codebook 22 largely increases. Especially, in case a vector-quantization is applied to the coding, the memory capacity requirement indexically increases in proportion to the increase in the number of bits for coding of the representative synthesis unit. Conversely, if the number of bits for coding of the synthesis unit decreases to decrease the memory capacity requirement, the quality of the synthesized speech goes down.

SUMMARY OF THE INVENTION

It is an object of the present invention to provide a speech synthesis apparatus and a method for generating high-quality synthetic speech without increasing the capacity requirement of the speech source signal codebook.

According to the present invention, a speech synthesis apparatus for synthesizing a speech signal by filtering a speech source signal through a synthesis filter, comprises: speech source signal codebook means for storing a plurality of speech source signals as a code vector; unit dictionary memory means for storing a plurality of synthesis units corresponding to phonemic symbols, each synthesis unit comprising an index of the code vector in said speech source signal code book means and a shift number for the code vector to decode the speech source signal; unit selection means for selecting a synthesis unit corresponding to phonemic symbols to be synthesized from said unit dictionary memory means; and synthesis unit decode means for selecting the code vector corresponding to the index in the synthesis unit from said speech source signal codebook means, and for shifting the code vector as the shift number in the synthesis unit.

Further in accordance with the present invention, there is also provided a speech synthesis method for synthesizing a speech signal by filtering a speech source signal through a synthesis filter, comprising the steps of: storing a plurality of speech source signals as a code vector in a speech source signal codebook; storing a plurality of synthesis units corresponding to each phonemic symbols, each synthesis unit comprising an index of the code vector and a shift number for the code vector to decode the speech source signal in a unit dictionary memory; selecting a synthesis unit corresponding to phonemic symbols to be synthesized from said unit dictionary memory; selecting the code vector corresponding to the index in the synthesis unit from said speech source signal codebook; and shifting the code vector according to the shift number in the synthesis unit.

Further in accordance with the present invention, there is also provided a computer readable memory containing computer-readable instructions to synthesize a speech signal by filtering a speech source signal through a synthesis filter, comprising the steps of: instruction means for causing a computer to store a plurality of speech source signals as a code vector in a speech source signal codebook; instruction means for causing a computer to store a plurality of synthesis units corresponding to each phonemic symbols, each synthesis unit comprising an index of the code vector and a shift number for the code vector to decode the speech source signal in a unit dictionary memory; instruction means for causing a computer to select a synthesis unit corresponding to phonemic symbols to be synthesized from said unit dictionary memory; instruction means for causing a computer to select the code vector corresponding to the index in the synthesis unit from said speech source signal codebook; and instruction means for causing a computer to shift the code vector according to the shift number in the synthesis unit.

BRIEF DESCRIPTION OF THE DRAWINGS

FIG. 3 is a block diagram of the speech synthesis apparatus according to a first embodiment of the present invention.

FIG. 7 is a block diagram of the speech synthesis apparatus according to a second embodiment of the present invention.

DETAILED DESCRIPTION OF THE PREFERRED EMBODIMENT

Hereafter, embodiments of the present invention will be explained by referring to the figures. The speech synthesis system according to the present invention includes a synthesis system by rule and a unit dictionary coding system. During speech synthesis, the regular synthesis system operates. The unit dictionary coding system generates the coded representative synthesis unit as the unit dictionary information by previous-coding. The synthesis system by rule as the first and second embodiments is explained and the unit dictionary coding system as the third, fourth, fifth embodiments is explained.

Figure 1:
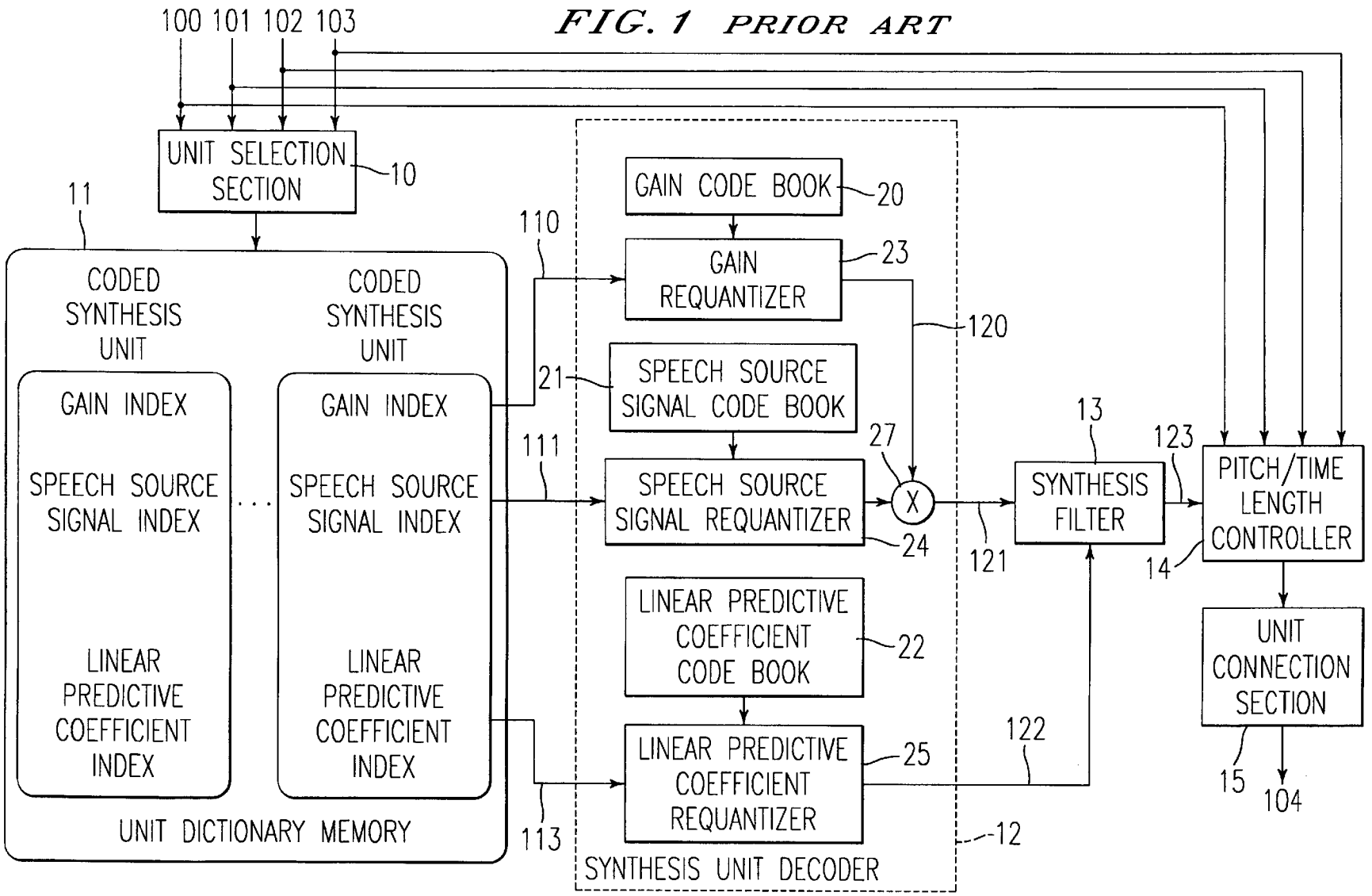
FIG. 1 PRIOR ART
FIG. 1 is a block diagram of the speech synthesis apparatus according to the prior art.
Figure 2:
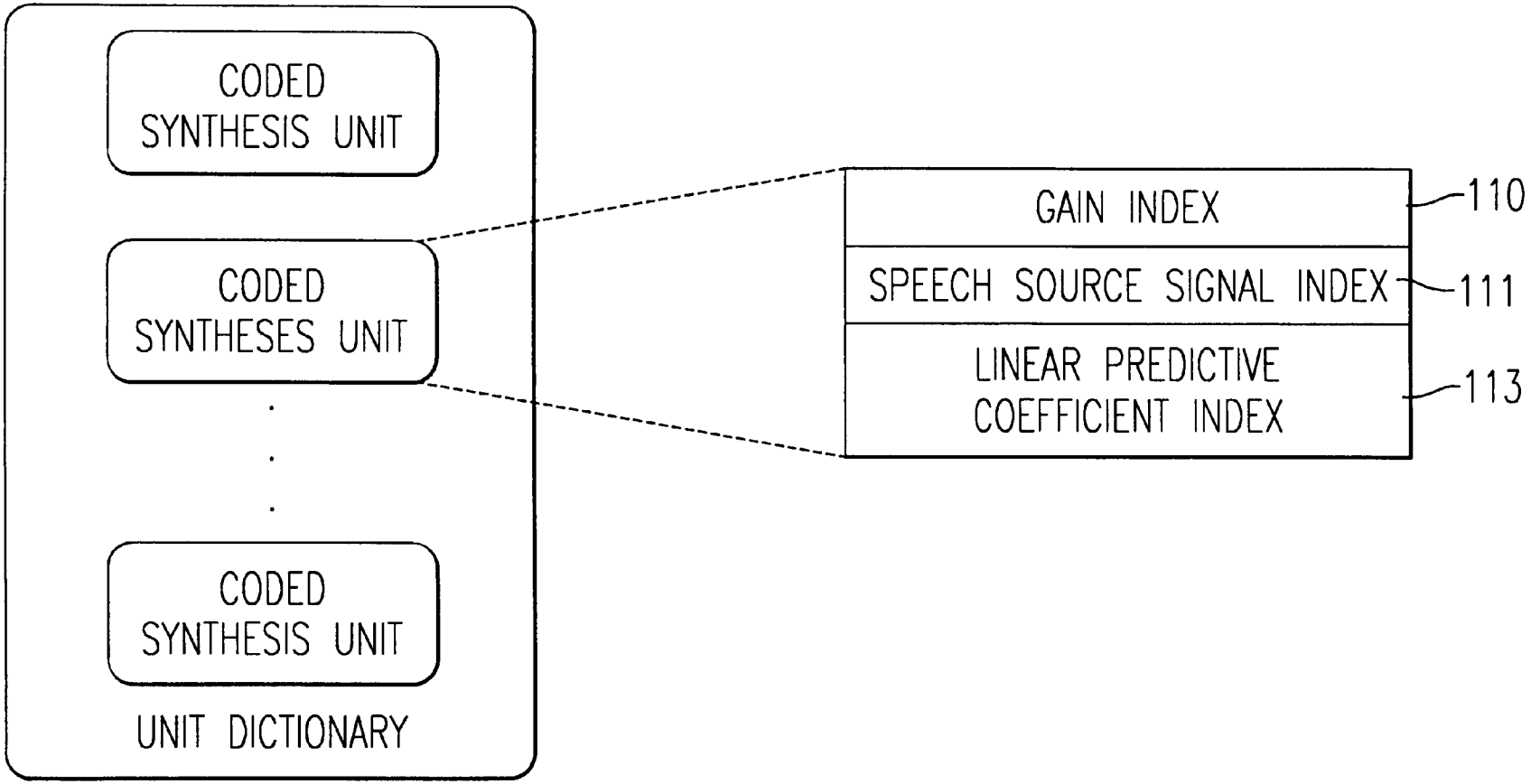
FIG. 2 PRIOR ART
FIG. 2 is a schematic diagram of the unit dictionary in FIG. 1.
Figure 4:
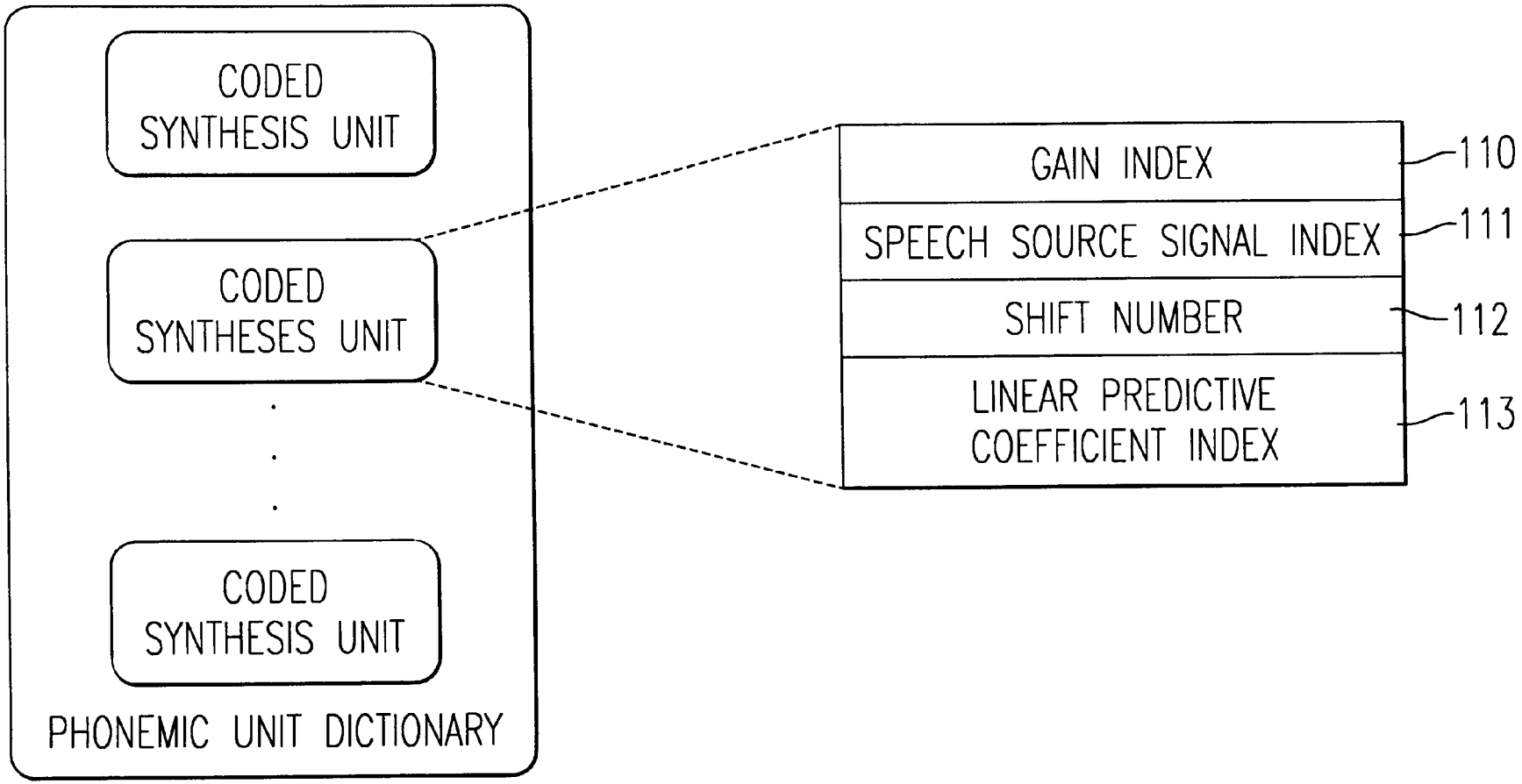
FIG. 4 is a schematic diagram of the unit dictionary in FIG. 3.

FIG. 3 is a block diagram of the regular synthesis system according to the first embodiment of the present invention. This synthesis system by rule comprises a unit selection section 10, a unit dictionary memory 11 for storing a plurality of coded synthesis units as the unit dictionary information, a synthesis unit decoder 12 for decoding the coded synthesis unit, a synthesis filter 13, a pitch/time length controller 14, and a unit connection section 15. FIG. 4 is a schematic diagram of the content of the coded synthesis unit stored in the unit dictionary memory 11. As shown in FIG. 4, the coded synthesis unit consists of a gain index 110, a speech source signal index 111, a shift number 112 for the code vector selected from the speech source signal codebook 21, and a linear predictive coefficient index 113. In short, the shift number 112 added to the coded representative synthesis unit is different from the construction shown in FIG. 2.

On the other hand, the synthesis unit decoder 12 comprises a gain codebook 20, a speech source signal codebook 21, a linear predictive coefficient codebook 22, a gain requantizer 23, a speech source signal requantizer 24, a linear predictive coefficient requantizer 25, a code vector shift section 26, and a multiplier 27. The code vector shift section 26 shifts the code vector selected from the speech source signal codebook 21 as the shift number 112.

Next, activation of the synthesis system by rule of the first embodiment is explained for text-to-speech system as an example. First, a sentence analysis/rhythm control section (not shown in the Figs.) analyzes a text to be supplied to the text-to-speech system and outputs prosodic information (the phoneme symbols 100, the phonemic time length 101, the pitch pattern 102, and the power 103) to the unit selection section 10. The unit selection section 10 selects one coded synthesis unit from the unit dictionary memory 11 according to the prosodic information. The coded synthesis unit is inputted to the synthesis unit decoder 12. In the synthesis unit decoder 12, the linear predictive coefficient index 113 is inputted to the linear predictive coefficient requantizer 25. The linear predictive coefficient requantizer 25 selects a code vector corresponding to the linear predictive coefficient index 113 from the linear predictive coefficient codebook 22 and outputs a decoded (requantized) linear predictive coefficient 122. The gain index 110 is inputted to the gain requantizer 23. The gain requantizer 23 selects a code vector corresponding to the gain index 110 from the gain codebook 20 and outputs a decoded (requantized) gain 120. Furthermore, the speech source signal index 111 is inputted to the speech source signal requantizer 24. The speech source signal requantizer 24 selects a code vector corresponding to the speech source signal index 111 from the speech source signal codebook 21. The code vector shift section 26 cyclically shifts the selected code vector as the shift number 112. The multiplier 27 multiplies the gain 120 with the shifted code vector. In this way, the speech source signal 121 is decoded. In this case, the shift for the code vector is an operation by moving the code vector as the shift number and by extracting a predetermined length part from the moved code vector. A cyclic shift is one kind of this shift operation. In the cyclic shift, if the predetermined length part shifted is not partially included in the code vector of original position, the head part of the code vector is cyclically extracted as a continuation of the rear part of the code vector as the predetermined length.

Figure 5A:
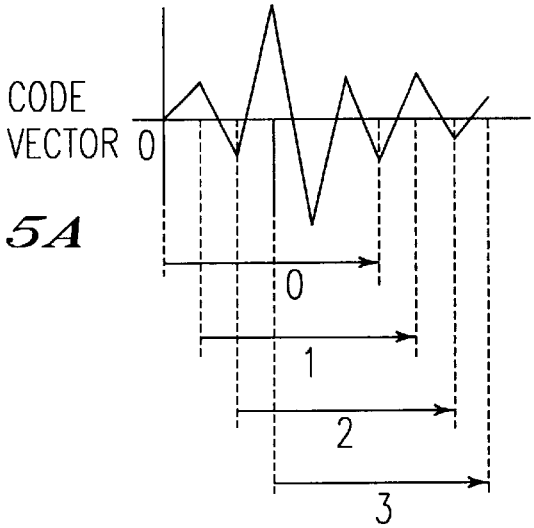
FIG. 5 is a schematic diagram of simple shift operation of the code vector shift section in FIG. 3.
Figure 5B:
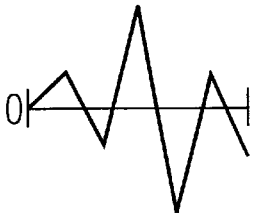
Figure 5C:
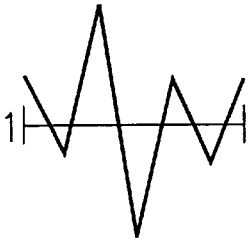
Figure 5D:
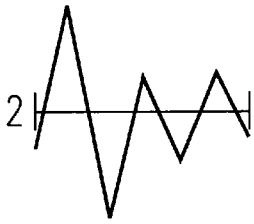
Figure 5E:
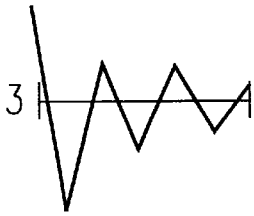

First, by referring to FIGS. 5A~5E, a normal shift operation (it is called as "simple shift") is explained. FIG. 5A shows a code vector stored in the speech source signal codebook and an extracted area corresponding to each shift number. In this example, a length of the code vector is "10". FIGS. 5B~5E respectively show the simple shift operation in case of shift number "0~3". As shown in FIG. 5A, assume that the length of the code vector is "10" and a length of the extracted area is "7". In case of the shift number "0", the area from 0-th vector to sixth vector is extracted (FIG. 5B). In case of the shift number "1", the area from first vector to seventh vector is extracted (FIG. 5C). In case of the shift number "2", the area from second vector to eighth vector is extracted (FIG. 5D). In case of the shift number "3", the area from third vector to ninth vector is extracted (FIG. 5E).

Figure 6A:
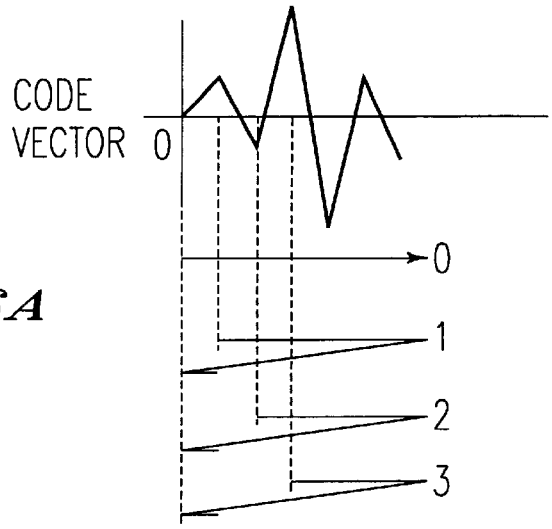
FIG. 6 is a schematic diagram of cyclic shift operation of the code vector shift section in FIG. 3.
Figure 6B:
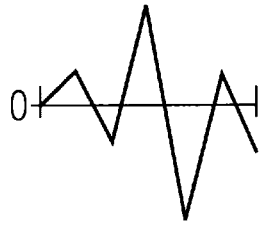
Figure 6C:
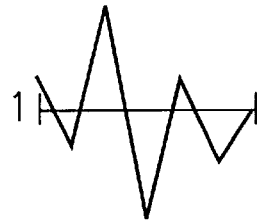
Figure 6D:
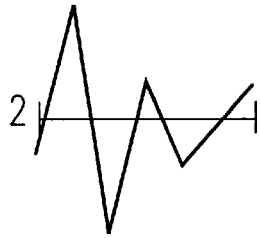
Figure 6E:
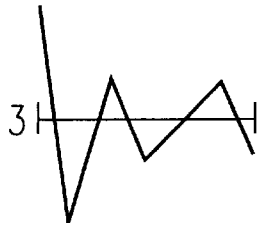

Next, by referring to FIGS. 6A~6E, the cyclic shift operation is explained. FIG. 6A shows a code vector stored in the speech source signal codebook 21 and an extracted area corresponding to each shift number. In this example, a length of the code vector is "7". FIGS. 6B~6E respectively show the cyclic shift operation in case of the shift number "0"~"3". As shown in FIG. 6A, assume that a length of the code vector is "7" and a length of the extracted area is "7". In case of the shift number "0", the area from 0-th vector to sixth vector is extracted (FIG. 6B). In case of the shift number "1", the area from first vector to sixth vector is extracted and the area of 0-th vector is continuously extracted (FIG. 6C). In case of the shift number "2", the area from second vector to sixth vector is extracted and the area from 0-th vector to first vector is continuously extracted (FIG. 6D). In case of the shift number "3", the area from third vector to sixth vector is extracted and the area from 0-th vector to second vector is continuously extracted (FIG. 6E). Either the simple shift or the cyclic shift may be used. However, in case of the cyclic shift, a length of the code vector stored in the speech source signal codebook 21 is short and the memory capacity requirement decreases.

Then, in FIG. 3, the linear predictive coefficient 122 decoded by the linear predictive coefficient requantizer 25 is supplied to the synthesis filter 13 as filter coefficient. The synthesis filter 13 executes filtering process for the speech source signal 121, and a speech signal 123 by synthesis unit is generated. The speech signal 123 is inputted to the pitch/time length control section 14. The pitch/time length control section 14 controls the pitch and the time length of the speech signal 123 according to the prosodic information such as the phoneme symbols 100, the phonemic time length 101, the pitch pattern 102 and the power 103. The unit connection section 15 connects the speech signals of a plurality of continuous synthesis units and the synthesized speech signal 104 is outputted.

In this way, in the present invention, by shifting the code vector selected from the speech source signal codebook 21, a plurality of code vectors corresponding to shift times are generated from one code vector. In this case, the unit dictionary memory 11 stores the shift number 112. However, the memory capacity needed for the shift number 112 is a little and the memory capacity requirement of the speech source signal code memory 21 greatly decreases. Accordingly, while the total memory capacities of the unit dictionary memory 11 and each memory 20, 21, 22 decrease, the quality of the synthesized speech rises up. Furthermore, in the first embodiment, the gain and the linear predictive coefficient are previously coded. Therefore, the memory capacity requirement is further decreased.

FIG. 7 is a block diagram of the synthesis system by rule according to the second embodiment of the present invention. In the second embodiment, the synthesis filter 13 located between the gain multiplier 27 and the pitch/time length controller 14 in FIG. 3 is deleted and the synthesis filter 17 is located at an output side of the unit connection section 15 as shown in FIG. 7.

The activation of the synthesis system by rule is explained. First, in the same way as in the first embodiment, the prosodic information such as the phoneme symbols 100, the phonemic time length 101, the pitch pattern 102 and the power 103 are inputted to the unit selection 10. The unit selection section 10 selects the coded synthesis unit from the unit dictionary memory 11 according to the prosodic information. The coded synthesis unit is outputted to the synthesis unit decoder 12. In the synthesis unit decoder 12, the linear predictive coefficient index 113 is inputted to the linear predictive coefficient requantizer 25. The linear predictive coefficient requantizer 25 selects code vector corresponding to the linear predictive coefficient index 113 from the linear predictive coefficient codebook 22, and decodes (requantizes) as the linear predictive coefficient 122. The gain index 110 is inputted to the gain requantizer 23. The gain requantizer 23 selects code vector corresponding to the gain index 110 from the gain codebook 20, and decodes (requantizes) as the gain 120. Furthermore, the speech source signal index 111 is inputted to the speech source signal requantizer 24. The speech source signal requantizer 24 selects code vector corresponding to the speech source signal index 111 from the speech source signal codebook 21. The code vector shift section 26 cyclically shifts the selected code vector according to the shift number 112. The multiplier 27 multiplies the gain 120 with the shifted code vector. In this way, the speech source signal 121 is decoded. The decoded speech source signal 121 is inputted to the pitch/time length control section 14. The pitch/time length control section 14 controls the pitch and the time length of the speech source signal 121 according to the prosodic information such as the phoneme symbols 100, the phoneme continuous time length 101, the pitch pattern 102, and the power 103. The unit connection section 15 connects the speech source signals of a plurality of continuous synthesis units. Then, the speech source signal 124 is inputted to the synthesis filter 17. In this case, the linear predictive coefficient 122 decoded by the linear predictive coefficient requantizer 25 is supplied to the synthesis filter 17 as a filter coefficient. The synthesis filter 17 executes a filtering process for the speech source signal 124, and the synthesis speech signal 104 is outputted. In the second embodiment, an effect the same as in the first embodiment is apparently obtained.

Figure 8:
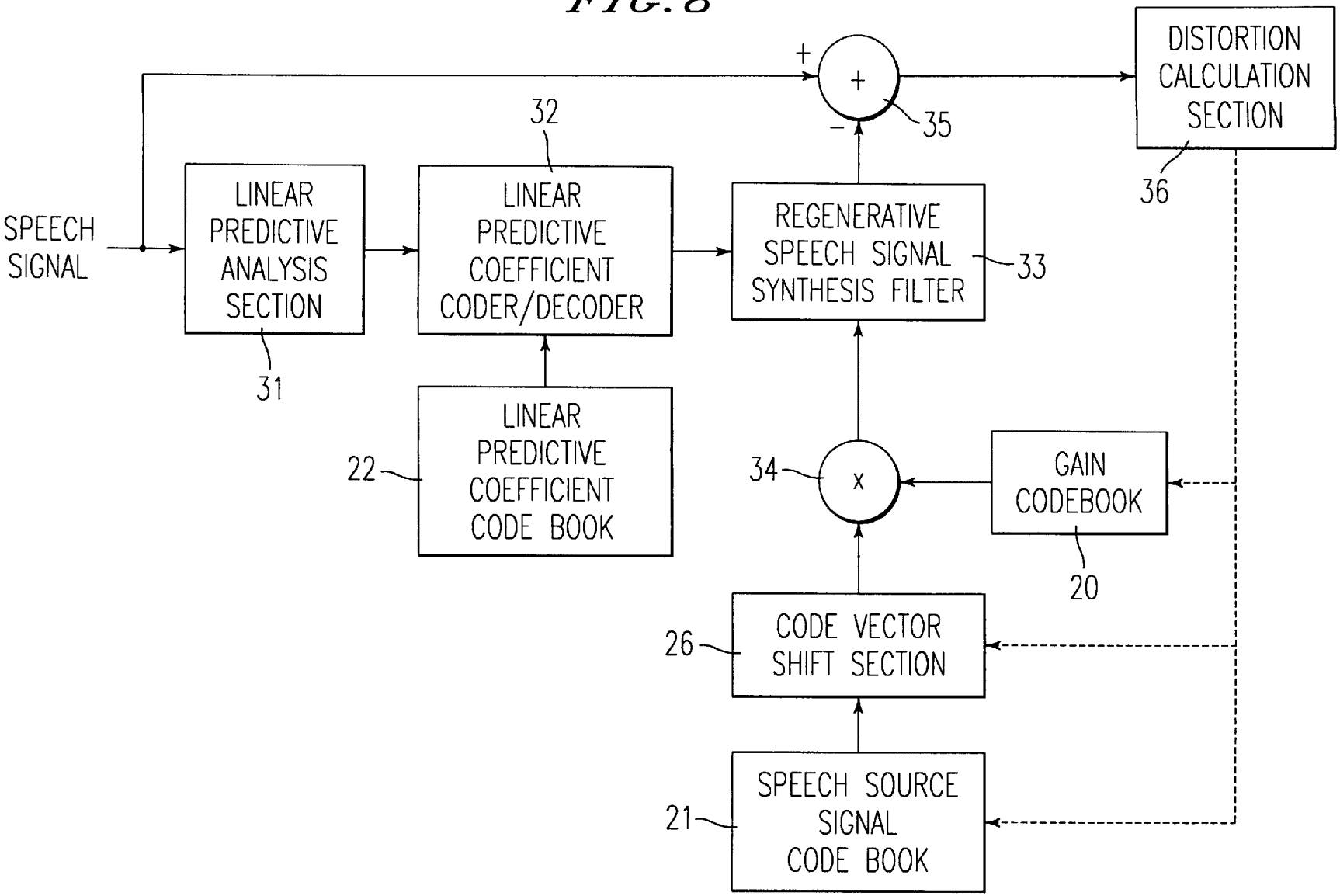
FIG. 8 is a block diagram of a unit dictionary coding system according to a third embodiment of the present invention.

FIG. 8 is a block diagram of the unit dictionary coding system according to the third embodiment of the present invention. The third embodiment includes an apparatus and method for creating the unit dictionary memory that includes a speech source signal index and a shift number. As shown in FIG. 8, the unit dictionary coding system comprises a gain codebook 20, a speech source signal codebook 21, a linear predictive coefficient codebook 22, a code vector shift section 26, a linear predictive analysis section 31, a linear predictive coefficient coder/decoder 32, a regenerative speech signal synthesis filter 33, a gain multiplier 34, a subtractor 35, and a distortion calculation section 36. In this case, the gain codebook 20, the speech source signal codebook 21, and the code vector shift section 26 may be commonly used as the same devices in the embodiment shown in FIG. 3. First, a speech signal stored in a synthesis unit is inputted to the linear predictive analysis section 31 to calculate a linear predictive coefficient. The linear predictive coefficient is coded and decoded by the linear predictive coefficient coder/decoder 32 and supplied to the regenerative speech signal synthesis filter 33. The linear predictive coefficient coder/decoder 32 comprises a coder to code the linear predictive coefficient and a decoder to decode the coded linear predictive coefficient. The coder codes the linear predictive coefficient by referring to the linear predictive coefficient codebook 22. The decoder decodes the coded result as the linear predictive coefficient by referring to the linear predictive coefficient codebook 22. In this case, the linear predictive coefficient is coded by searching for a code vector from the linear predictive coefficient codebook 22 so that any distortion between the code vector and the linear predictive coefficient obtained by the linear predictive analysis section 31 is minimized. On the other hand, the code vector, as a candidate of the speech source signal, is selected from the speech source signal codebook 21. The code vector is cyclically shifted by the code vector shift section 26. The multiplier multiplies the shifted code vector with the gain selected from the gain codebook 20.

The regenerative speech signal synthesis filter 33 executes a filtering process for the multiplied code vector and outputs a regenerative speech signal. The subtractor 35 calculates the difference between the regenerative speech signal and an original speech signal (the speech signal stored in the synthesis unit). The distortion calculation section 36 searches for the gain index in the gain codebook 20, the speech source signal index in the speech source signal codebook 21, and the shift number to minimize the difference. In this case, the difference (distortion) is calculated using equation (1) as a distortion evaluation measure, or equation (2) as a hearing weighted distortion evaluation measure.

$$\begin{aligned} d &= |e_{ijs}|^2 \\ &= |X - giH'vjs|^2 \end{aligned} \tag{1}$$

$$\begin{aligned} dw &= |e_{wijs}|^2 \\ &= |e_{ijs}W|^2 \\ &= |(X - g_iH'v_{js})W|^2 \end{aligned} \tag{2}$$

d: distortion evaluation measure $d_w$: weighted distortion evaluation measure

X: original speech signal in the synthesis unit

H': matrix representing characteristic of synthesis filter determined by linear predictive coefficient $g_i$: i-th gain stored in the gain codebook $v_{js}$: speech source signal by shifting j-th code vector in speech source signal codebook as shift number S W: matrix representing weight $e_{ijs}$: error signal between original speech signal and regenerative speech signal $e_{wijs}$: weighted error signal between original speech signal and regenerative speech signal Furthermore, assume that "$c_j$" is j-th code vector in the speech source signal codebook, "$S_s$" is a matrix representing cyclic shift operation as the shift number "s", "Z" is a dimension number of the code vector. In this case, the matrix "$S_s$" and the speech source signal "$v_{js}$" are represented as following equations (3) (4).

$$S_s = \begin{array}{c} \leftarrow Z \rightarrow \\ \leftarrow s \rightarrow \\ \left[\begin{array}{ccc|ccc} 0 & \cdots & 0 & 1 & \cdots & 0 \\ \cdots & \cdots & \cdots & \cdots & \ddots & \cdots \\ 0 & \cdots & 0 & 0 & \cdots & 1 \\ \hline 1 & \cdots & \cdots & \cdots & \cdots & \cdots \\ \cdots & \ddots & \cdots & \cdots & \cdots & \cdots \\ 0 & \cdots & 1 & 0 & \cdots & 0 \end{array}\right] \begin{array}{l} \uparrow \\ Z \\ \downarrow \end{array} \\ \uparrow s \downarrow \\ \leftarrow s \rightarrow \end{array} \tag{3}$$

$$v_{js} = S_sC_j \tag{4}$$

Figure 9:
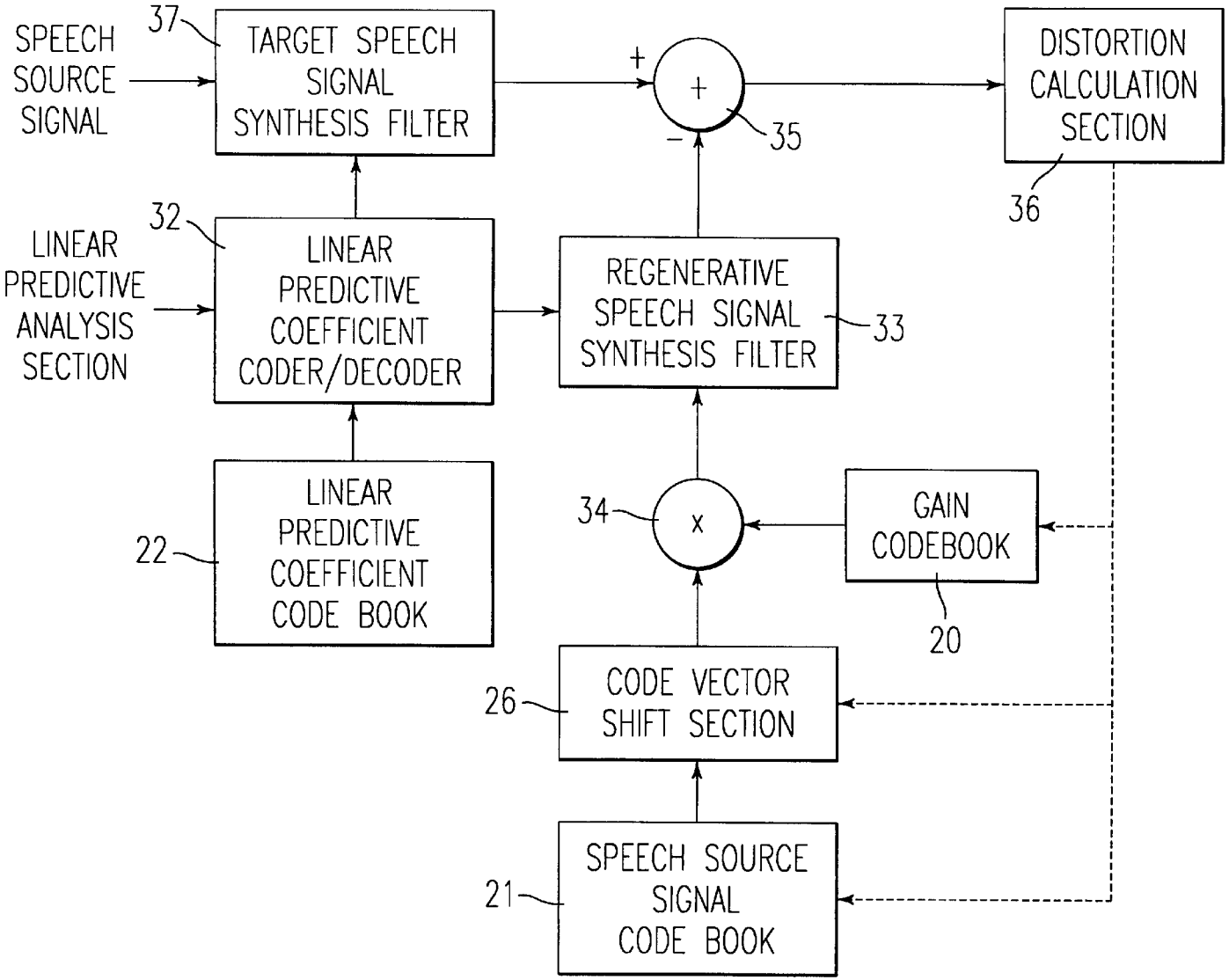
FIG. 9 is a block diagram of the unit dictionary coding system according to a fourth embodiment of the present invention.

FIG. 9 is a block diagram of the unit dictionary coding system according to the fourth embodiment of the present invention. First, the linear predictive coefficient stored in the synthesis unit is inputted to the linear predictive coefficient coder/decoder 32. After coding and decoding, the linear predictive coefficient is inputted to the regenerative speech signal synthesis filter 33 and a target speech signal synthesis filter 37. The target speech signal synthesis filter 37 outputs a target speech signal by inputting an original speech source signal. The regenerative speech signal synthesis filter 33 outputs a regenerative speech signal by inputting a processed signal of the code vector in the speech source signal codebook 21. In the same way as in the third embodiment, the linear productive coefficient coder/decoder 32 comprises a coder to code the linear predictive coefficient and a decoder to decode the coded linear predictive coefficient. The coder codes the linear predictive coefficient by referring to the linear predictive coefficient codebook 22. The decoder decodes the coded result as the linear predictive coefficient by referring to the linear predictive coefficient codebook 22. In this case, the linear predictive coefficient is coded by searching for a code vector from the linear predictive coefficient codebook 22 so that a distortion between the code vector and the original linear predictive coefficient is minimized. On the other hand, the code vector, as a candidate of the speech source signal is selected from the speech source signal codebook 21. The code vector is cyclically shifted by the code vector shift section 26. The multiplier multiplies the shifted code vector with the gain selected from the gain codebook 20. The regenerative speech signal synthesis filter 33 executes a filtering process for the multiplied code vector and outputs a regenerative speech signal. The target speech signal synthesis filter 37 inputs the linear predictive coefficient coded/decoded by the linear predictive coefficient coder/decoder 32 as filter coefficient and executes a filtering process for the original speech source signal to output the target speech signal. Last, in same way of the third embodiment, the subtractor 35 calculates a difference between the regenerative speech signal and the target speech signal. The distortion calculation section 36 searches the gain code index in the gain codebook 20, the speech source signal code index in the speech source signal codebook 21 and the shift number to minimize the difference.

Figure 10:
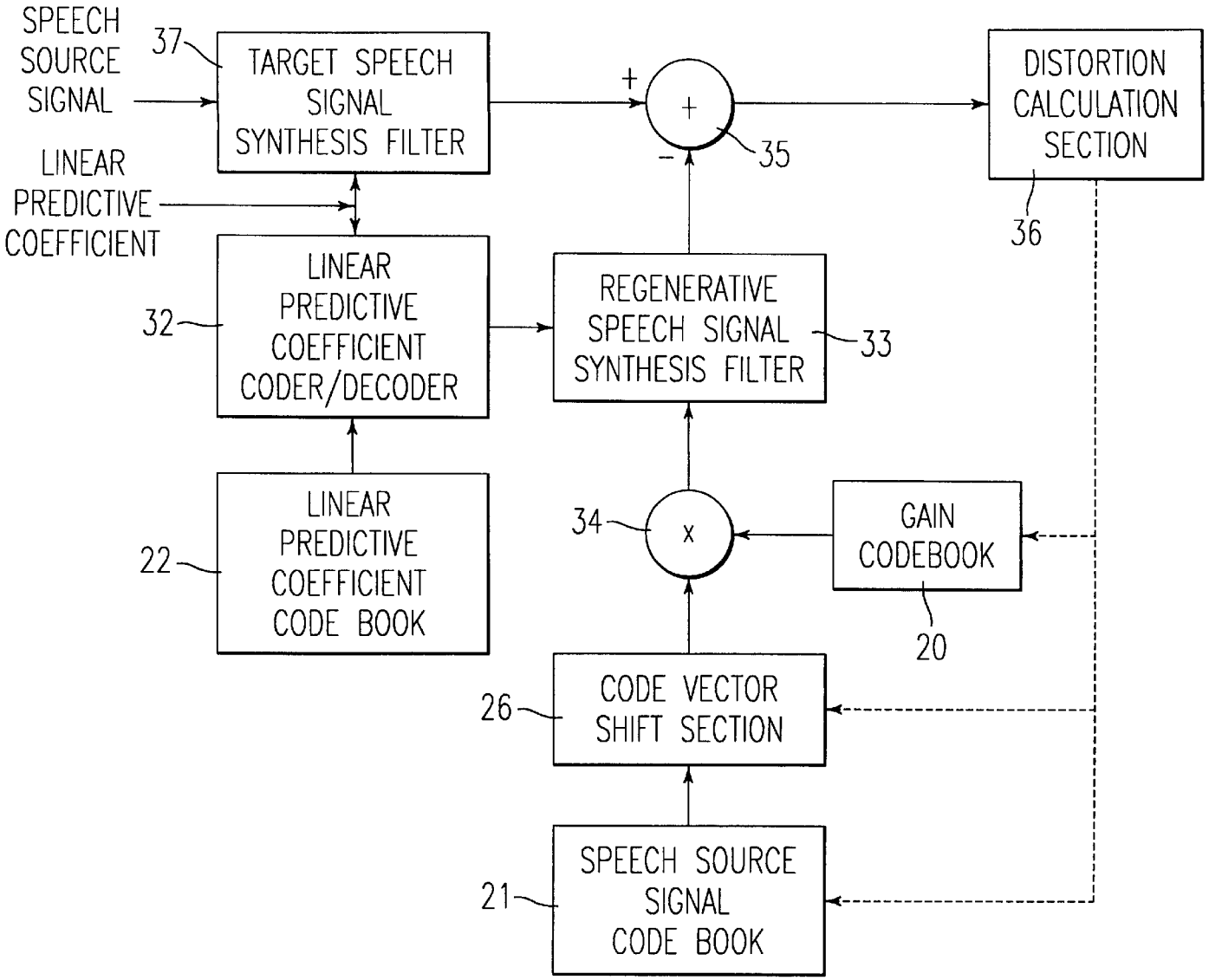
FIG. 10 is a block diagram of the unit dictionary coding system according to a fifth embodiment of the present invention.

FIG. 10 is a block diagram of the unit dictionary coding system according to the fifth embodiment of the present invention. First, the linear predictive coefficient stored in the synthesis unit is inputted to the linear predictive coefficient coder/decoder 32. After coding and decoding, the linear predictive coefficient is inputted to the regenerative speech signal synthesis filter 33 as a filter coefficient. In the same way as in the third and fourth embodiments, the linear predictive coefficient coder/decoder 32 comprises a coder to code the linear predictive coefficient and a decoder to decode the coded linear predictive coefficient. The coder codes the linear predictive coefficient by referring to the linear predictive coefficient codebook 22. The decoder decodes the coded result as the linear predictive coefficient by referring to the linear predictive coefficient codebook 22. In this case, the linear predictive coefficient is coded by searching a code vector from the linear predictive coefficient codebook 22 so that a distortion between the code vector and the original linear predictive coefficient is minimized. On the other hand, the code vector, as a candidate of the speech source signal, is selected from the speech source signal codebook 21. The code vector is cyclically shifted by the code vector shift section 26. The multiplier multiplies the shifted code vector with the gain selected from the gain codebook 20. The target speech signal synthesis filter 37 outputs the target speech signal by inputting the original speech source signal and the linear predictive coefficient. Then, the subtractor 35 calculates a difference between the regenerative speech signal and the target speech signal. The distortion calculation section 36 searches the gain index in the gain codebook 20, the speech source signal index in the speech source signal codebook 21, and the shift number to minimize the difference.

In each above-mentioned embodiment, as the linear predictive coefficient representing characteristic of the synthesis filter, parameter such as LPC coefficient, PARCOR coefficient or LSP coefficient may be used. If a coefficient to uniquely determine the characteristic of the synthesis filter is used, the coefficient is not necessarily limited to the linear predictive coefficient. For example, cepstrum or a coefficient obtained by converting the LPC coefficient, the PARCOR coefficient, LSP coefficient or the cepstrum may be used. In short, as the coefficient representing the characteristic of the synthesis filter, spectral parameter is used.

Furthermore, in each above-mentioned embodiment, the shift number of the code vector in the speech source signal codebook 21 is determined to minimize the difference between the regenerative speech signal and the target speech signal. However, a method for determining the shift number is not limited to the above-mentioned method. For example, the shift number may be determined to coincide a peak of the code vector in the speech source signal codebook with a peak of the original speech source signal. In this method, the difference between the regenerative speech signal and the target speech signal is approximately minimized in the same way as in the above-mentioned method.

The present invention is not limited to the above-mentioned embodiments. For example, in each embodiment, all of the linear predictive coefficient, the speech source signal and the gain are coded. However, the speech source signal may be only coded, and the linear predictive coefficient and the gain may not be coded.

A memory device, including a CD-ROM, floppy disk, hard disk, magnetic tape, or semiconductor memory can be used to store instructions for causing a processor or computer to perform the process described above.

Other embodiments of the invention will be apparent to those skilled in the art from consideration of the specification and practice of the invention disclosed herein. It is intended that the specification and examples be considered as exemplary only, with the true scope and spirit of the invention being indicated by the following claims.

What is claimed is:

1. Speech synthesis method for synthesizing a speech signal by filtering a speech source signal through a synthesis filter, comprising the steps of:

storing a plurality of speech source signals as a code vector in a speech source signal codebook;

storing a plurality of synthesis units corresponding to phonemic symbols, each synthesis unit comprising an index of the code vector and a shift number for the code vector to decode the speech source signal in a unit dictionary memory;

selecting a synthesis unit corresponding to phonemic symbols to be synthesized from said unit dictionary memory;

selecting the code vector corresponding to the speech source signal index in the synthesis unit from said speech source signal codebook; and shifting the code vector according to the shift number in the synthesis unit.

2. The speech synthesis apparatus according to claim 1, further comprising the step of:

previously coding said speech signal as the speech source signal index of the code vector, the shift number and a gain value so that said speech signal is almost equals to a synthesized speech signal generated by multiplication of the gain value with the shifted code vector.

3. The speech synthesis method according to claim 1, further comprising the step of:

storing a plurality of gain values as a code vector to decode the speech source signal in a gain codebook;

wherein the synthesis unit includes a gain index of the coded gain in said gain codebook in addition to the index of the code vector in said speech source signal codebook and the shift number.

4. The speech synthesis method according to claim 3, further comprising the steps of:

selecting the gain value corresponding to the gain index in the synthesis unit from said gain codebook; and multiplying the gain value with the shifted code vector.

5. The speech synthesis method according to claim 1, further comprising the step of:

storing a plurality of coefficients as a code vector, each of which represents characteristics of the synthesis filter to input the speech source signal in a coefficient codebook;

wherein the synthesis unit includes a coefficient index of the code vector in said coefficient codebook in addition to the index of the code vector in said speech source signal codebook and the shift number.

6. The speech synthesis method according to claim 5, further comprising the steps of:

selecting the coefficient corresponding to the coefficient index in the synthesis unit from said coefficient codebook; and supplying the coefficient to the synthesis filter.

7. The speech synthesis method according to claim 1, further comprising the step of;

cyclically shifting the code vector according to the shift number.

8. The speech synthesis method according to claim 1, further comprising the steps of:

selecting the code vector corresponding to the speech source signal index; and shifting a requantized code vector according to the shift number.

9. The speech synthesis method according to claim 1, wherein the shift number is determined to minimize distortion between an original speech signal and a synthesis speech signal generated by the synthesis filter filtering a shifted speech source signal, a coefficient obtained by analyzing the original speech signal being supplied to the synthesis filter.

10. The speech synthesis method according to claim 1, wherein the shift number is determined to minimize distortion between a target speech signal generated by a target speech signal synthesis filter filtering the speech source signal and a synthesis speech signal generated by the synthesis filter filtering a shifted speech source signal, a coefficient corresponding to the speech source signal being supplied to the target speech signal synthesis filter and the synthesis filter.

11. The speech synthesis method according to claim 1, wherein the shift number is determined so as to match a peak of the speech source signal with a peak of the code vector selected.

12. Speech synthesis apparatus for synthesizing a speech signal by filtering a speech source signal through a synthesis filter, comprising:

speech source signal codebook means for storing a plurality of speech source signals as a code vector;

unit dictionary memory means for storing a plurality of synthesis units corresponding to phonemic symbols, each synthesis unit comprising an index of the code vector in said speech source signal codebook means and a shift number for the code vector to decode the speech source signal;

unit selection means for selecting a synthesis unit corresponding to phonemic symbols to be synthesized from said unit dictionary memory means; and synthesis unit decode means for selecting the code vector corresponding to the speech source signal index in the synthesis unit from said speech source signal codebook means, and for shifting the code vector according to the shift number in the synthesis unit.

13. The speech synthesis apparatus according to claim 12, wherein said speech signal is previously coded as the speech source signal index of the code vector, the shift number and a gain value so that said speech signal is almost equals to a synthesized speech signal generated by multiplication of the gain value with the shifted code vector.

14. The speech synthesis apparatus according to claim 12, further comprising a gain codebook means for storing a plurality of gain values as a code vector to decode the speech source signal, wherein the synthesis unit includes a gain index of the code vector in said gain codebook in addition to the index of the code vector in said speech source signal codebook and the shift number.

15. The speech synthesis apparatus according to claim 14, wherein said synthesis unit decode means selects the gain value corresponding to the gain index in the synthesis unit from said gain codebook means, and multiplies the gain value with the shifted code vector.

16. The speech synthesis apparatus according to claim 12, further comprising a coefficient codebook means for storing a plurality of coefficients as a code vector, each of which represents characteristics of the synthesis filter to input the speech source signal, wherein the synthesis unit includes a coefficient index of the code vector in said coefficient codebook in addition to the index of the code vector in said speech source signal codebook and the shift number.

17. The speech synthesis apparatus according to claim 16, wherein said synthesis unit decode means selects the coefficient corresponding to the coefficient index in the synthesis unit from said coefficient codebook means, and supplies the coefficient to the synthesis filter.

18. The speech synthesis apparatus according to claim 12.

wherein said synthesis unit decode means cyclically shifts the code vector according to the shift number.

19. The speech synthesis apparatus according to claim 12, wherein said synthesis unit decode means selects the code vector corresponding to the speech source signal index, and shifts a requantized code vector according to the shift number.

20. The speech synthesis apparatus according to claim 12, wherein the shift number is determined to minimize distortion between an original speech signal and a synthesis speech signal generated by the synthesis filter filtering a shifted speech source signal, a coefficient obtained by analyzing the original speech signal being supplied to the synthesis filter.

21. The speech synthesis apparatus according to claim 12, wherein the shift number is determined to minimize distortion between a target speech signal generated by a target speech signal synthesis filter filtering the speech source signal and a synthesis speech signal generated by the synthesis filter filtering a shifted speech source signal, a coefficient corresponding to the speech source signal being supplied to the target speech signal synthesis filter and the synthesis filter.

22. The speech synthesis apparatus according to claim 12, wherein the shift number is determined so as to match a peak of the speech source signal with a peak of the code vector selected from said speech source code memory means.

23. A computer readable memory containing computer-readable instructions to synthesize a speech signal by filtering a speech source signal through a synthesis filter, comprising the steps of:

instruction means for causing a computer to store a plurality of speech source signals as a code vector in a speech sorce signal codebook;

instruction means for causing a computer to store a plurality of synthesis units corresponding to phonemic symbols, each synthesis unit comprising an index of the code vector and a shift number for the code vector to decode the speech source signal in a unit dictionary memory;

instruction means for causing a computer to select a synthesis unit corresponding to phonemic symbols to be synthesized from said unit dictionary memory;

instruction means for causing a computer to select the code vector corresponding to the speech source signal index in the synthesis unit from said speech source signal codebook; and instruction means for causing a computer to shift the code vector according to the shift number in the synthesis unit.

* * * * *